US005405194A

United States Patent [19]

Binder

[11] Patent Number: 5,405,194

[45] Date of Patent: Apr. 11, 1995

[54] SHELF FOR A VACUUM-DRYING CABINET

[76] Inventor: Peter M. Binder, Santisstrasse 74a, D-7770 Uberlingen, Germany

[21] Appl. No.: 38,975

[22] Filed: Mar. 29, 1993

[30] Foreign Application Priority Data

Apr. 2, 1992 [DE] Germany ..... 42 10 938.8

[51] Int. Cl.[6] ..... A47B 97/00

[52] U.S. Cl. ..... 312/205; 312/410; 211/175; 126/337 A

[58] Field of Search ..... 312/205, 319.2, 410; 108/65, 136, 137, 42, 44, 39, 93; 211/175; 126/41 D, 337 A

[56] References Cited

U.S. PATENT DOCUMENTS 1,069,411 8/1913 Greene ..... 312/205
3,242,575 3/1966 Manaresi et al. .
4,195,577 4/1980 Gross ..... 108/42

FOREIGN PATENT DOCUMENTS 795741 3/1936 France .
1221081 5/1960 France .
127092 8/1928 Switzerland .

*Primary Examiner*—Peter R. Brown
*Assistant Examiner*—Gerald A. Anderson
*Attorney, Agent, or Firm*—Popham, Haik, Schnobrich & Kaufman, Ltd.

[57] ABSTRACT

A removable shelf for a vacuum-drying cabinet is machanically expandable so that it comes into thermal contact under pressure over a large area with the heated walls of the cabinet interior. The shelf can be inserted into a supporting framework which can be freely positioned in the cabinet interior and can be removed for cleaning. A baffle plate on the supporting framework protects the material to be dried from strong air currents when the cabinet interior is evacuated.

15 Claims, 2 Drawing Sheets

SHELF FOR A VACUUM-DRYING CABINET

The present invention relates to a shelf for a cabinet and particularly but not exclusively to removable shelves for vacuum-drying cabinets.

Vacuum-drying cabinets are used for the rapid and efficient drying of temperature-sensitive substances, powders, porous material, small parts, etc. The material to be dried is disposed on removable shelves in the vacuum-drying cabinet. The shelves are removably inserted in the interior of the vacuum-drying cabinet so that on the one hand the material to be dried can easily be introduced into the cabinet and on the other hand the shelves can be removed for cleaning. The drying of the material in the vacuum-drying cabinet is performed by evacuating the cabinet interior and then heating the material. The heating of the material is nearly always effected by thermal conduction. Heating by convection does not occur in practice, as the cabinet interior is evacuated at a pressure of up to $10^{-2}$ mbar (hPa). In practice the material is not heated by radiation either, as no substantial radiation occurs in the temperature range used of up to a maximum of 200° to 300° C.

Essentially two possible techniques for heating the material carried by the shelf by thermal conduction are known, i.e. shell heating and plate heating.

In shell heating, the walls of the interior of the vacuum-drying cabinet are heated. The heat is conducted from these walls via the shelves to the material to be dried. In this case the shelves lie loosely on support devices, such as, for example, bearing rails or bearing bars, which are mounted on the walls of the cabinet interior. As the shelves only lie loosely on the support devices, a relatively poor thermal contact is produced between the heated walls and the shelf, so that the material is only heated slowly. The support devices mounted on the walls obstruct the cleaning of the cabinet interior when the shelves have been removed.

In plate heating, the shelves are themselves electrically heated. As a result the material positioned on the shelves can be quickly and efficiently heated. However the heatable shelves are considerably more expensive to manufacture. It is more difficult to remove the shelves because of the electrical connections required. The contacts for the electrical heating of the shelves, which are located in the cabinet interior, constitute an explosion hazard, e.g. if small parts cleaned with easily flammable solvents are dried. Finally, thorough cleaning of the cabinet interior is impeded by the support devices for the shelves.

According to one aspect of the present invention, there is provided a shelf suitable for removable insertion into a vacuum-drying cabinet having heatable walls, which shelf can be mechanically expanded in at least one dimension so that in the expanded state it maintains heat-conducting contact with the heated walls of the cabinet interior.

Preferably, the shelf is maintained in contact with the heated walls under pressure.

According to another aspect of the present invention, there is provided a cabinet having at least one shelf in accordance with the present invention, including a plurality of supports for removably supporting the at least one shelf, the supports being arranged on a removable supporting frame which can be freely positioned in the interior of the cabinet.

For insertion into the cabinet interior and removal from the cabinet interior the shelf may be compressed contrary to the expansion direction, so that it has sufficient clearance with respect to the walls of the cabinet interior. When the shelf is located in the cabinet interior, it may be expanded and come into contact with the walls of the cabinet interior under pressure. As a result there is good thermal contact between the heated walls and the shelf, so that the heat of the heated walls can quickly be transmitted to the shelf in order to heat the material to be dried.

The expansion of the shelf can take place in various ways, provided that the shelf comes into contact with the walls of the cabinet interior by this expansion. It is possible to provide grooves for the introduction of the shelf in the vertical side walls and to construct the edge of the shelf to be guided in these grooves so that it can be expanded in the vertical direction, so that it abuts the upper and lower edge of the grooves under pressure. It is also possible to make the shelf expandable in the direction of insertion, so that in the expanded state it abuts the vertical rear wall and the door of the cabinet interior. However a lateral expansion of the shelf is advantageous. As a result the shelf can abut the vertical side walls of the cabinet interior.

In order to obtain the best possible: thermal contact between the walls of the cabinet interior and the shelf, the contact between the shelf and the walls of the cabinet interior may be constructed with the largest possible surface area. For this purpose the shelf expediently has an edge having a large surface area parallel to the walls of the cabinet interior, with which it abuts the walls. In the design in which the shelf expands laterally, this edge may be a marginal strip bent by 90° at the longitudinal edges of the shelf.

The expansion of the shelf is preferably performed by spring action. This has the advantage on the one hand of ensuring that the shelf fully abuts the walls of the cabinet interior with a large surface area independently of manufacturing tolerances. On the other hand, the shelf abutting the walls of the cabinet interior under spring action may also follow deformations in the walls, which occur when the walls are heated and in particular when the cabinet interior is evacuated.

If the shelf is expandable by spring action, a possibility is expediently provided of locking the shelf in its contracted state, so that it can be easily inserted into the cabinet interior and can be removed therefrom. The locking can be effected by a catch, by cams, by a jointed link mechanism or similar devices.

The shelves can be produced at an advantageous cost. The production costs are only slightly higher than the production costs of conventional shelves of shell-heated vacuum-drying cabinets and are substantially lower than the production costs of shelves in plate-heated vacuum-drying cabinets. As the shelves are not directly heated, no electrical connections are provided in the cabinet interior, so that the vacuum-drying cabinet is explosion-proof. The thermal conduction between the heated walls of the cabinet interior and the shelves of conventional shell-heated vacuum-drying cabinets are considerably improved, so that rapid heating of the material to be dried and thus clearly shorter process times can be achieved. The good thermal contact with the heated walls also improves the accuracy with which the temperature of the material to be dried can be observed.

As the thermal contact between the shelves and the heated walls of the cabinet interior is effected by the expansion of the shelf, thermal contact between the walls of the cabinet interior and the shelf via the supporting devices is no longer necessary. Therefore the supporting devices no longer have to be mounted on the walls of the cabinet interior. As a result the support devices can be constructed on a supporting framework which is freely inserted into the cabinet interior and can be removed from the cabinet interior for cleaning. The cabinet interior can therefore be constructed with completely flat-surfaced walls, whereby thorough cleaning of the cabinet interior is facilitated.

In an advantageous embodiment the supporting framework may in addition be provided with a baffle plate, which is disposed between the opening of the vacuum connection and the material to be dried positioned on the shelves. The baffle plate protects the material to be dried from a direct suction effect and air movement during suction, so that swirling of the material is avoided even with a dusty or powdery material.

A specific embodiment of the present invention will now be described in detail with reference to the accompanying drawings, in which.

Figure 1:
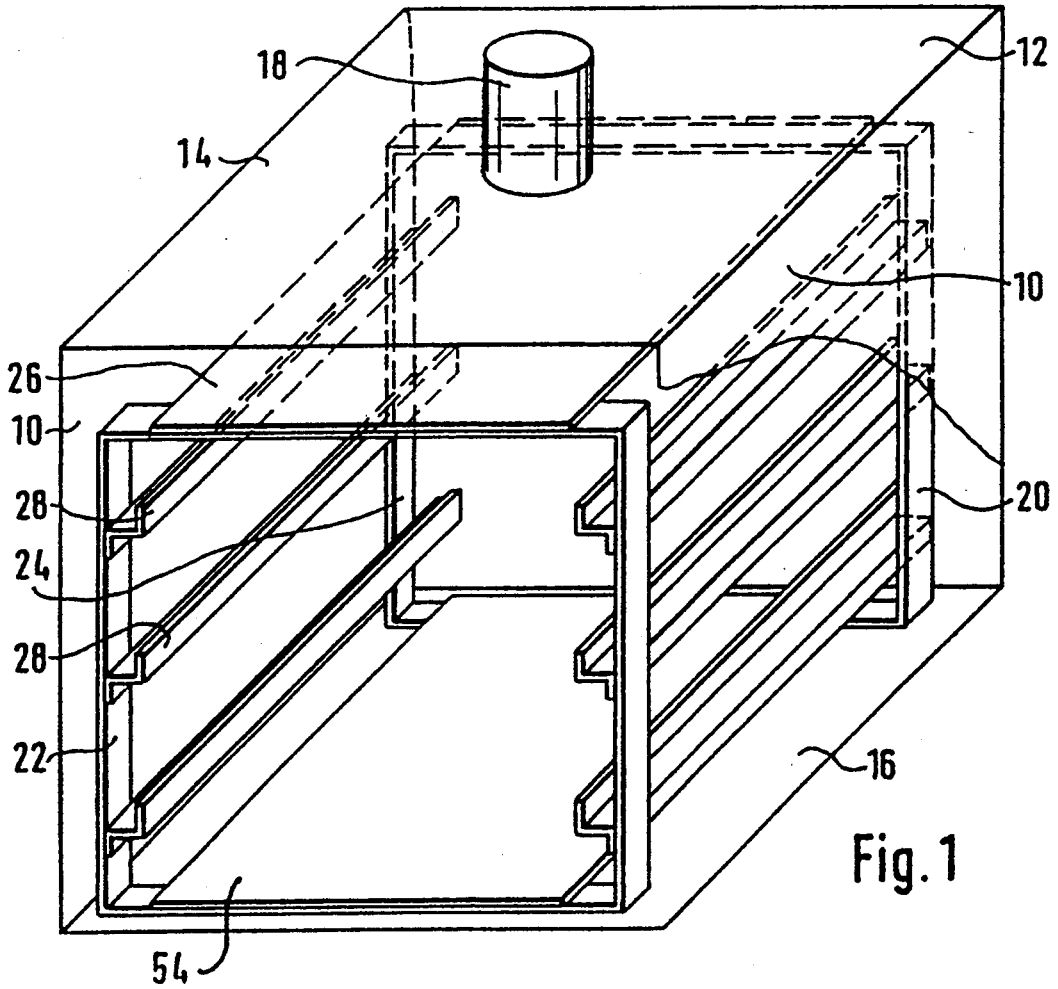
FIG. 1 shows a perspective diagram of the interior of a vacuum-drying cabinet, without a door and with a side wall partly broken open, with a supporting framework for shelves placed in the cabinet interior.

FIG. 1 shows the interior of the vacuum-drying cabinet. The cabinet interior is formed by a pressure-resistant, cuboid housing made from thin steel plate with side walls 10, a rear wall 12, a ceiling 14 and a floor 16. The housing is surrounded by an outer housing (not shown), so that an air jacket is formed, in which heating elements, which heat the walls 10,12,14,16 of the cabinet interior, are disposed. The open front side of the cabinet interior is sealed in vacuum-tight manner by a door, which is not shown. A vacuum connection 18, via which the cabinet interior can be evacuated and through which dry air or an inert gas can also be supplied if necessary, opens through the ceiling 14 into the cabinet interior. The walls of the cabinet interior formed by the side walls 10, the rear wall 12, the ceiling 14 and the floor 16 are completely smooth and have no projections or depressions, so that it is possible to clean the cabinet interior simply and thoroughly.

A supporting framework 20 is freely inserted into the cabinet interior. The supporting framework 20 comprises a front frame 22 and a rear frame 24. Frames 22 and 24 have an open rectangular cross-section, the width of which is almost equal to the width of the cabinet interior, while the height of the frames 22 and 24 is somewhat less than the height of the cabinet interior. Frames 22 and 24 are manufactured from circumferential flat strip steel. A baffle plate 26 made from steel plate is attached on top of the frames 22 and 24 by spot welding. A corresponding plate 54 made from steel plate is mounted on the bottom of the frames 22 and 24 to stabilise the supporting framework 20. The baffle plate 26 and the plate 54 connect the front frame 22 with the rear frame 24 and keep these frames at such a distance part that when the framework 20 is inserted the rear frame 24 is disposed directly in front of the rear wall 12 and the front frame 22 is disposed at the open front side of the cabinet interior. The width of the baffle plate 26 is chosen so that on both sides it maintains a spacing from the side walls 10. The baffle plate 26 thus protects the cabinet interior and in particular the space inside the supporting framework 20 from the vacuum connection opening in the centre into the ceiling 14. However the vertical distance of the baffle plate 26 from the ceiling wall 14 and the lateral distance of the baffle plate 26 from the side walls 10 guarantees a sufficient passage area for the suction of air out of the cabinet interior through the vacuum connection 18.

Bearing rails 28, which are equidistantly and inwardly directed, are welded to the vertical posts of frames 22 and 24. The bearing rails 28 form a support for a shelf 30, as is represented in FIGS. 2 to 5.

Each shelf 30 consists of an upper support plate 32 and a backing plate 34, which abuts the lower surface of said upper plate and has its surface parallel thereto. The support plate 32 and the backing plate 34 are made from a sheet of a metal which is a good conductor of heat. The surface dimensions of the support plate 32 are chosen so that it substantially fills the entire interior of the supporting framework 20. The upper support plate 32 supports the material to be heated.

When the shelf 30 is inserted into the supporting framework 20, one longitudinal edge of the support plate 32 extending in the direction of insertion (in FIGS. 2 to 4 this is the right longitudinal edge) engages between the vertical post of the frames 22 and 24 and laterally beyond them and is bent downwardly at right angles as a marginal strip 36 having a large area. The support plate 32 lies with an inwardly bent edge 56 with lateral clearance on the bearing rails 28 and can be displaced in the transverse direction until the marginal strip 36 comes to abut the lateral wall 10 of the cabinet interior with its entire area.

The backing plate 34 is displaceably guided in the transverse direction on the under side of the support plate 32. For this purpose dowel pins 38, which engage in slots 40 in the backing plate 34 extending in the transverse direction, are attached to the under side of the support plate 32. The length of the slots 40 determines the travel of the reciprocal transverse movement of support plate 32 and backing plate 34. At both its longitudinal edges extending in the direction of insertion, the backing plate 34 is bent downwardly at right angles in the form of marginal strips 42 and 44 respectively. The backing plate 34 protrudes with one marginal strip 42 (in FIGS. 2 to 4 the left edge-strip) past the corresponding longitudinal edge of the support plate 32, whereby the travel determined by the dowel pins 38 and the slots 40 determines the amount by which the backing plate 34 with the marginal strip 42 protrudes past the longitudinal edge of the support plate 32. The region of the backing plate 34 which protrudes past the support plate 32 has dimensions in the direction of insertion such that the backing plate 34 which the downwardly bent marginal strip 42 can engage in the transverse direction between the frames 22 and 24 of the supporting framework. The marginal strip 42 lies with one inwardly bent edge 58 on the bearing rails 28.

Figure 2:
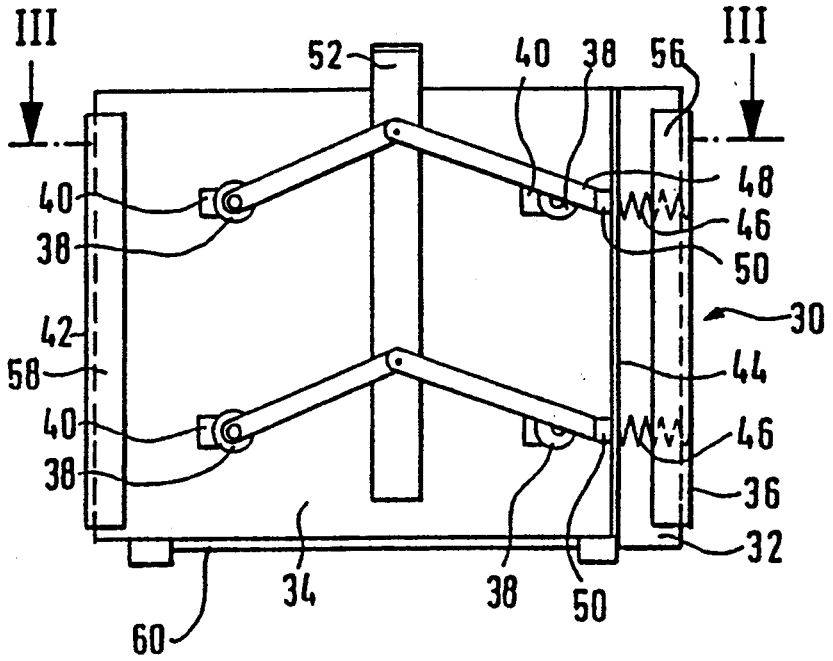
FIG. 2 shows a view from below of a shelf for the vacuum-drying cabinet of FIG. 1.
Figure 3:
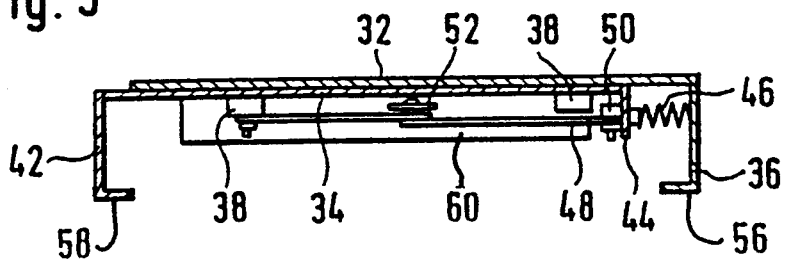
FIG. 3 shows a vertical cross-section through the shelf along the intersection line III—III in FIG. 2.
Figure 4:
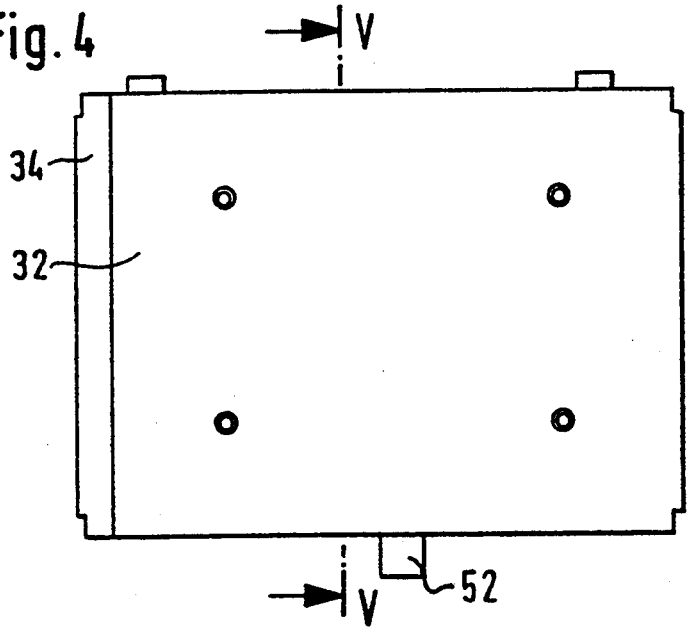
FIG. 4 shows a plan view of the shelf from above.
Figure 5:
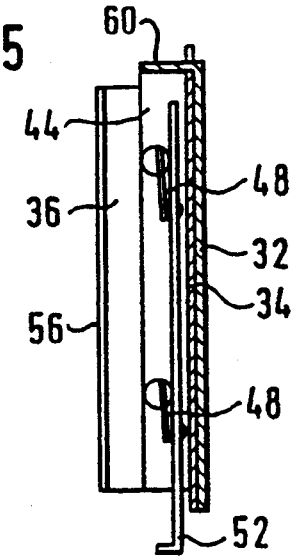
FIG. 5 shows a vertical longitudinal section through the shelf along the intersection line V—V in FIG. 4.

In the transverse direction the width of the backing plate 34 is less than the width of the support plate 32. As a result the marginal strip 44 of the backing plate 34, which is bent downwardly at right angles in FIG. 2 to 4, is spaced from the marginal strip 36 of the support plate 32. Two helical compression springs 46 are inserted between the marginal strips 36 and 44. The helical compression springs 46 are prestressed so that they force apart the support plate 32 and the backing plate 34 into the position in which the backing plate 34 maximally protrudes past the support plate 32. The expansion length is limited by the dowel pins 38 and the slots 40. If the shelf 30 is inserted into the cabinet interior and is expanded by the helical compression springs 46, the marginal strip 36 of the support plate 32 comes to abut one side wall 10 of the cabinet interior and the marginal strip 42 of the backing plate 34 comes to abut the opposite side wall 10 with a large area under the pressure of the helical compression springs 46. As a result good thermal contact is produced between the heated side walls 10 and the shelf 30.

In order to insert the shelf 30 easily into the cabinet interior and to remove it therefrom, the support plate 32 and the backing plate 34 can be compressed against the pressure of the helical compression springs 46 and be locked in this contracted position. Two jointed links 48 are provided for this purpose. One end point of the jointed links 48 is coupled to one of the dowel pins 38 and thus to the support plate 32. The other end point of the jointed links 48 is coupled to the downwardly bent marginal strip 44 of the backing plate 34, e.g. to a fixing bolt 50 screwed to this marginal strip 44, for the helical compression springs 46. A slide 52 shared by both jointed links 48, which extends up to the front transverse edge of the shelf 30 and consequently is accessible from the open front side of the cabinet interior when the shelf 30 is inserted, acts on the joints of the jointed links 48. If the jointed links 48 are forced by means of the slide 52 into their extended position, the support plate 32 and the backing plate 34 are pushed together against the force of the helical compression springs 34 and locked by the extension of the jointed links 48 in this contracted position. During this the slide 52 comes to abut a downwardly bent rear stop edge 60 of the backing plate 34. In this condition the shelf 30 can easily be, inserted into the support framework 20 or removed therefrom. If the shelf 30 in the cabinet interior is inserted into the support framework 20, the marginal strips 36 and 42 lie with their edges 56 and 58 on the bearing rails 28 of the support framework 20. The slide 52 is now pulled so that the jointed links 48 travel from their over-extended locking position into a bent position. The helical compression springs 46 can now force apart the support plate 32 and the backing plate 34 so that the marginal strips 36 and 42 come to abut the respective side walls 10 under the pressure of the helical compression springs 46. If the shelf 30 is to be removed again, the slide 52 is pushed in the direction of insertion as far as the stop edge 60 and brings the jointed links 48 back into the over-extended position, so that the shelf 30 is again locked in its contracted condition.

In order to guarantee that the support plate 32 and the backing plate 34 are guided without skewing, four dowel pins 38 and slots 40 are provided. Two helical compression springs 46, which are spaced in the direction of insertion, and jointed links 48 are also provided.

It can easily be seen that the compression of the support plate 32 and backing plate 34 against the force of the helical compression springs 46 can instead of by the jointed links 48 also be effected by other mechanical means, such as single-arm or two-arm links, cams or similar.

Thus, embodiments of the present invention provide a cost-advantageous design which enables the material to be dried to be heated rapidly and efficiently.

I claim:

1. A shelf removably insertable into a vacuum-drying cabinet having heatable walls, said shelf being formed of a heat conducting material and comprising:

heat transfer areas for contacting a large area of the walls of the cabinet;

expansion means mechanically expandable in at least one dimension for effecting heat-conducting contact of said heat transfer areas with the heated walls of the cabinet interior; and pressure-exerting means for exerting pressure against at least one of said heat transfer areas for maintaining said heat transfer areas in contact with the heated walls under pressure when said expansion means is expanded.

2. A shelf as claimed in claim 1, wherein said pressure-exerting means includes a spring, said expansion means being normally biased in an expanded condition by said spring.

3. A shelf as claimed in claim 2, further comprising locking means for locking said expansion means in a non-expanded condition against action of said spring.

4. A shelf as claimed in claim 1, wherein said expansion means is expandable in a lateral direction.

5. A shelf as claimed in claim 1, wherein the cabinet walls include first and second opposed interior side walls, said shelf further comprising:

a support plate;

a backing plate positioned on and parallel to said support plate, said backing plate being movable in a lateral direction relative to said support plate to define said expansion means;

a first elongate lateral portion projecting substantially perpendicularly from said support plate and oriented to abut the first interior side wall of the cabinet; and a second elongate lateral portion projecting substantially perpendicularly from said backing plate and oriented to abut the second interior side wall of the cabinet;

wherein said first and second elongate lateral portions define said heat transfer areas.

6. A shelf as claimed in claim 5, further comprising limit means for limiting lateral movement of said backing plate relative to said support plate.

7. A shelf removably insertable into a vacuum-drying cabinet having first and second opposed interior heatable side walls, said shelf comprising:

a support plate;

a backing plate positioned on and parallel to said support plate, said backing plate being movable in a lateral direction relative to said support plate between expanded and a non-expanded positions;

a first elongate lateral portion projecting substantially perpendicularly from said support plate and oriented to abut the first interior side wall of the cabinet;

a second elongate lateral portion projecting substantially perpendicularly from said backing plate and oriented to abut the second interior side wall of the cabinet, said first and second elongate lateral portions;

at least one spring inserted between said support plate and said backing plate for effecting outward lateral movement of said backing plate relative to said support plate and for maintaining said first and second elongate lateral portions in contact with the first and second interior side walls under pressure when said backing plate is in the expanded position.

8. A shelf as claimed in claim 7, wherein said at least one spring comprises at least one helical compression spring connected between said first and second elongate lateral portions.

9. A shelf as claimed in claim 7, further comprising locking means for locking said backing plate in its non-expanded position relative to said support plate, said locking means including at least one jointed link actuable to urge said backing plate into its non-expanded state relative to said support plate against the action of said at least one spring, and to lock said backing plate into its non-expanded state relative to said support plate when said at least one jointed link is in an over-extended position.

10. A cabinet comprising:

at least first and second opposed heatable walls defining a cabinet interior;

a removable supporting frame freely positionable in said interior of said cabinet, said supporting frame including a plurality of supports; and at least one shelf removably insertable into said cabinet interior and supportable on said supports, said at least one shelf including a heat transfer area and expansion means mechanically expandable in at least one dimension for effecting heat-conducting contact of said heat transfer area with said first and second walls.

11. A cabinet as claimed in claim 10, wherein said support frame comprises a front frame and a rear frame, said supports being mounted on said front and rear frames; and wherein said heat transfer area of said at least one shelf abuts said first and second walls when said expansion means is expanded in a lateral direction between said front and rear frames.

12. A cabinet as claimed in claim 10, wherein said supports comprise bearing rails on which said at least one shelf rests.

13. A cabinet as claimed in claim 10, wherein said cabinet is a vacuum-drying cabinet.

14. A cabinet as claimed in claim 13, further comprising:

a vacuum connection opening into said cabinet interior; and a baffle plate mounted on said supporting frame for protecting said at least one shelf from said vacuum connection when said at least one shelf is inserted into said supporting frame.

15. A cabinet comprising:

at least first and second opposed heatable walls defining a cabinet interior;

at least one shelf removably insertable into said cabinet, said shelf being formed of a heat conducting material and comprising:

heat transfer areas for contacting a large area of the walls of the cabinet;

expansion means mechanically expandable in at least one dimension for effecting heat-conducting contact of said heat transfer areas with the heated walls of the cabinet interior; and pressure-exerting means for exerting pressure against at least one of said heat transfer areas for maintaining said heat transfer areas in contact with the heated walls under pressure when said expansion means is expanded.

* * * * *